United States Patent [19]

Janer

[11] Patent Number: 4,988,962

[45] Date of Patent: Jan. 29, 1991

[54] CIRCUIT FOR CORRECTING GROUP DELAY AT MICROWAVE FREQUENCIES

[75] Inventor: Patrick Janer, Levallois-Perret, France

[73] Assignee: Alcatel Transmission Par Faisceaus Hertziens A.T.F.H., Perret Cedex, France

[21] Appl. No.: 427,397

[22] Filed: Oct. 27, 1989

[30] Foreign Application Priority Data

Oct. 27, 1988 [FR] France ..... 88 14027

[51] Int. Cl.[5] ..... H01P 1/32; H01P 5/12

[52] U.S. Cl. ..... 333/28 R; 333/136; 333/139

[58] Field of Search ..... 333/28 R, 139, 138, 333/140, 164, 127, 128, 213, 1.1, 136

[56] References Cited

U.S. PATENT DOCUMENTS

| | | | |
|---|---|---|---|
| 3,699,480 | 10/1972 | Mueller | 333/128 |
| 3,906,409 | 9/1975 | Whitehouse | 333/138 |
| 4,197,514 | 4/1980 | Kasuga et al. | 333/28 R |
| 4,367,445 | 1/1983 | Dydyk | 333/127 |

FOREIGN PATENT DOCUMENTS

| | | |
|---|---|---|
| 2747871 | 5/1979 | Fed. Rep. of Germany . |
| 2365243 | 4/1978 | France . |

OTHER PUBLICATIONS

Manton, "Hybrid Networks . . . Frequency Circuits", The Radio and Elec. Engineer, vol. 54, No. 11/12, Nov./Dec. 1984, pp. 473–489.

*Primary Examiner*—Eugene R. Laroche
*Assistant Examiner*—Seung Ham
*Attorney, Agent, or Firm*—Sughrue, Mion, Zinn, Macpeak & Seas

[57] ABSTRACT

A microwave frequency group delay corrector operates by reflecting the microwave on a correcting complex impedance (jx). It makes use of a power divider (13), of the Wilkinson type. The complex impedance (20) is connected to the port (14) which is normally the inlet port to the power divider (13). The microwave (E) is applied to one of the other two ports (15), and the remaining other port (16) is used as the port from which the phase corrected outlet microwave (S) is taken.

3 Claims, 2 Drawing Sheets

CIRCUIT FOR CORRECTING GROUP DELAY AT MICROWAVE FREQUENCIES

The present invention relates to a circuit for correcting group delay at microwave frequencies.

BACKGROUND OF THE INVENTION

Microwave telecommunications circuits making use of components such as filters, amplifiers, mixers, . . ., introduce group delay distortion. The term "group delay" or GD is used to designate the value of the delay due to a component having a transfer function, said delay being proportional to the frequency derivative of the phase. For example, in a lowpass filter this delay is a function of frequency, giving rise to a bell-shaped curve with a maximum situated at the cut-off frequency of the filter.

In radio beam transmission, and in particular in digital transmissions, it is important to be able to correct the group delay in order to avoid bit errors. Correction is generally performed at intermediate frequency, or sometimes in base band if the distortion is symmetrical. When demodulation is performed directly at microwave frequency, without using an intermediate frequency, it is necessary to correct group delay directly at microwave frequency.

Such correction must be capable of correcting the phase of the microwave as a function of frequency without changing its amplitude since that would itself constitute a source of bit errors in a digital transmission. The commonly adopted solution consists in general in reflecting the microwave on a mismatched complex impedance, with the curve showing the phase of this complex impedance as a function of frequency being complementary to the curve of the group delay to be corrected. By adding the delay curve to the group delay curve, a delay curve is obtained which is uniform as a function of frequency.

A first known type of GD corrector uses a 90° 3 dB coupler and two accurately identical complex impedances. This prior corrector is shown diagrammatically in accompanying FIG. 1. It uses a 90° 3 dB coupler referenced 5. The input microwave signal E is applied to inlet port 1 of the coupler 5. It exits via ports 3 and 4 of the coupler with respective phase shifts of 0° and of 90° . These two waves are reflected from respective complex impedances 6 and 7 of value jX, and having a phase curve which is complementary to the phase curve to be corrected, with the waves finally recombining in-phase at outlet port 2 of the coupler 5 (microwave outlet S), and combining antiphase at the inlet port 1 of the coupler.

This first form of prior corrector suffers from the following drawbacks:

the two complex impedances 6 and 7 must have exactly identical complex impedances jX, otherwise the waves will no longer be exactly antiphase when they combine at the inlet port 1 and as a result the corrector will not act as an allpass transmission filter;

the coupler must provide perfectly symmetrical coupling and a completely accurate 90° phase shift, otherwise the corrector will not behave as an allpass filter; and the corrector is difficult to adjust: the two complex impedances 6 and 7 must be adjusted identically both in amplitude and in frequency, otherwise the corrector will not behave as an allpass filter.

Another known type of GD corrector uses a ferrite microwave circulator together with only one correction complex impedance. The diagram for this corrector is shown in accompanying FIG. 2.

The inlet microwave E is applied to port 10 of circulator 8. It exits via the second port 11, is reflected on complex impedance 9 of value jX, re-enters the circulator 8 via port 11, and leaves the circulator S via its third port 12.

This other prior corrector suffers from the following drawbacks:

it is difficult to adjust for low amplitude GD since the ferrite circulator has its own relatively large GD;

such a circulator is difficult to integrate in microstrip technology circuits, particularly when the microwave frequency is about 1 GHz; and a ferrite circulator is relatively expensive, thereby increasing the overall cost of a GD corrector of this type.

The invention seeks to remedy these drawbacks.

SUMMARY OF THE INVENTION

To this end, the present invention provides a microwave frequency group delay corrector using a single complex impedance for providing GD correction by reflecting the microwave thereon without altering the amplitude transmission curve. The corrector uses a power divider, e.g. of the Wilkinson type, having a power inlet, and two outlets which are isolated from each other. The above-mentioned complex impedance is connected to the "inlet" port of the divider, whereas the inlet microwave is applied to one of the two "outlet" ports of the same divider and the outlet wave is taken from its other "outlet" port.

BRIEF DESCRIPTION OF THE DRAWINGS

An embodiment of the invention is described by way of example with reference to the accompanying drawings, in which.

DETAILED DESCRIPTION

Figure 1:
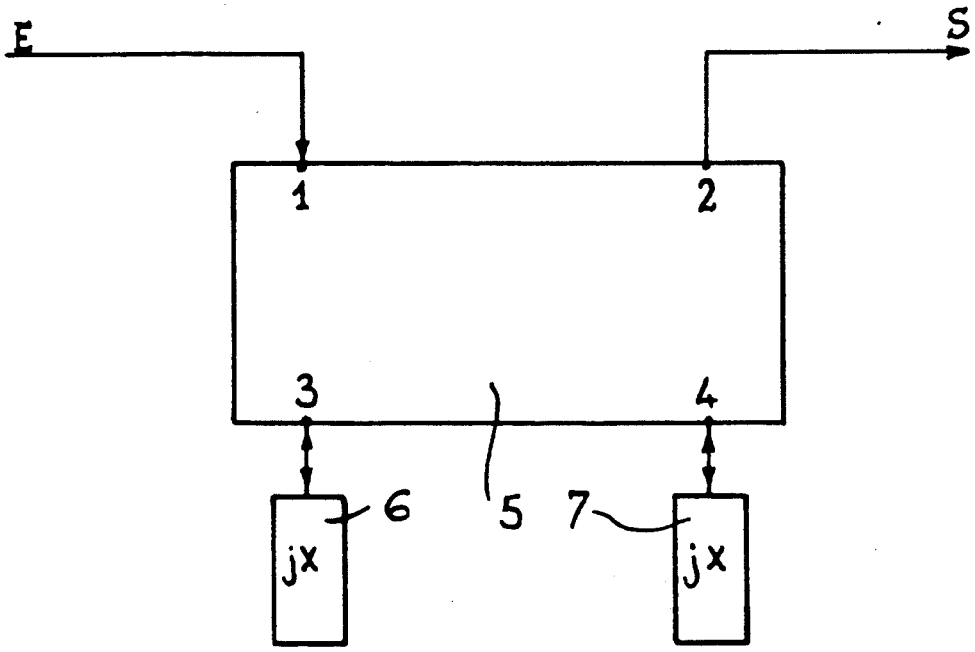
Fig. 1 (PRIOR ART)
FIGS. 1 and 2 are circuit diagrams of the prior art as described above.
Figure 2:
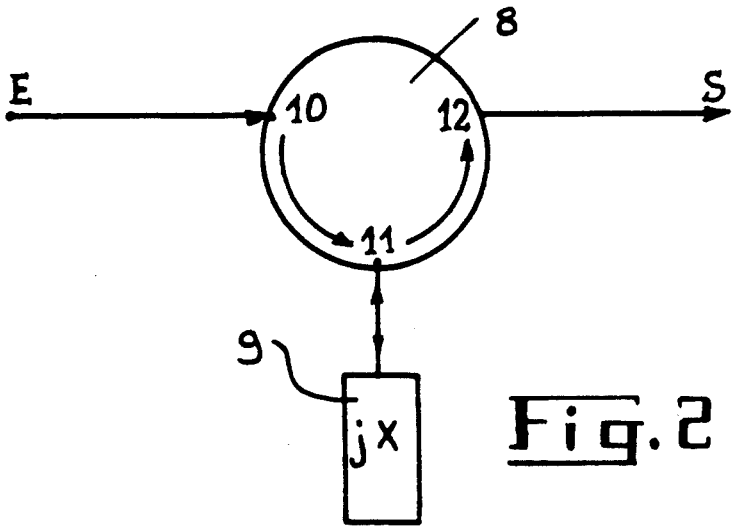
Fig. 2 (PRIOR ART)
Figure 3:
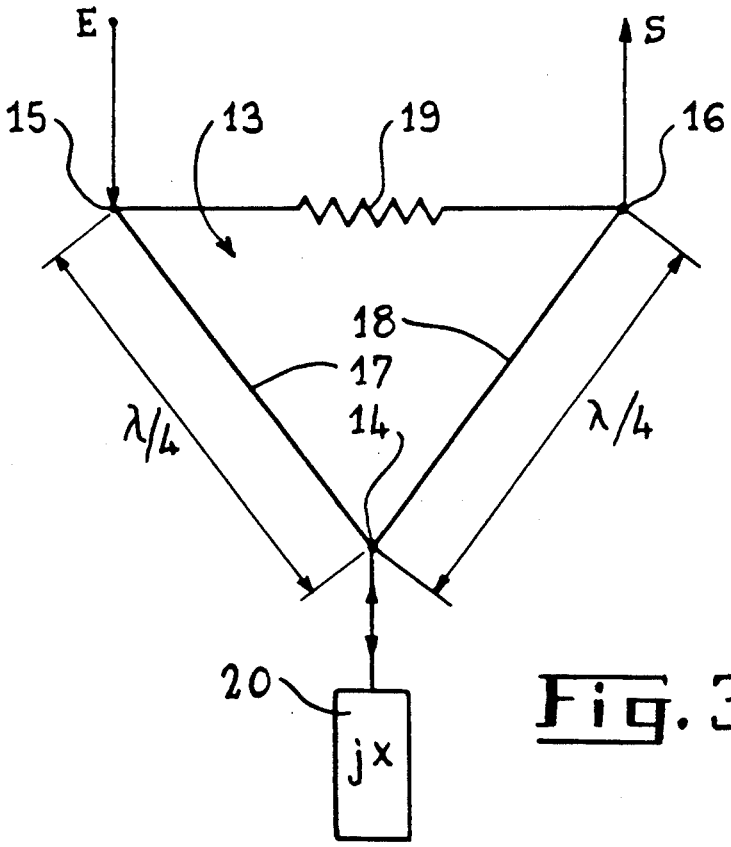
FIG. 3 is a circuit diagram of the GD corrector of the invention.

With reference to FIG. 3, reference 13 designates a Wilkinson type power divider. In conventional manner, the divider 13 has an "inlet" port 14 and two "outlet" ports 15 and 16. The inlet port 14 is connected to the two outlet ports 15 and 16 via respective quarterwave lines 17 and 18, and the two outlet ports 15 and 16 are interconnected via a balancing resistance 19. A microwave applied to the inlet 14 of the Wilkinson divider 13 exits therefrom at 15 and 16, symmetrically divided and attenuated by 3 dB. In contrast, its outlets 15 and 16 are isolated from each other, i.e. a wave applied to 15 is theoretically capable of exiting only via 14 and not via 16, and vice versa.

In this case, the power divider 13 is used in a very special manner. Its port 14 which is normally the inlet port is not used as such in this case, but is connected to a complex impedance 20 of value jX which is adjusted to obtain the desired group delay. Microwave E to be corrected is applied to port 15, i.e. to one of the two "outlet" ports of the divider. As in the above-mentioned case using a ferrite circulator, it exits via port 14, is reflected on the complex impedance 20 which corrects its phase, is reinserted into the divider via said port 14, and exits again, symmetrically attenuated by 3 dB, via both ports 15 and 16, with the useful corrected wave S being taken from port 16 as shown in the drawing.

Figure 4:
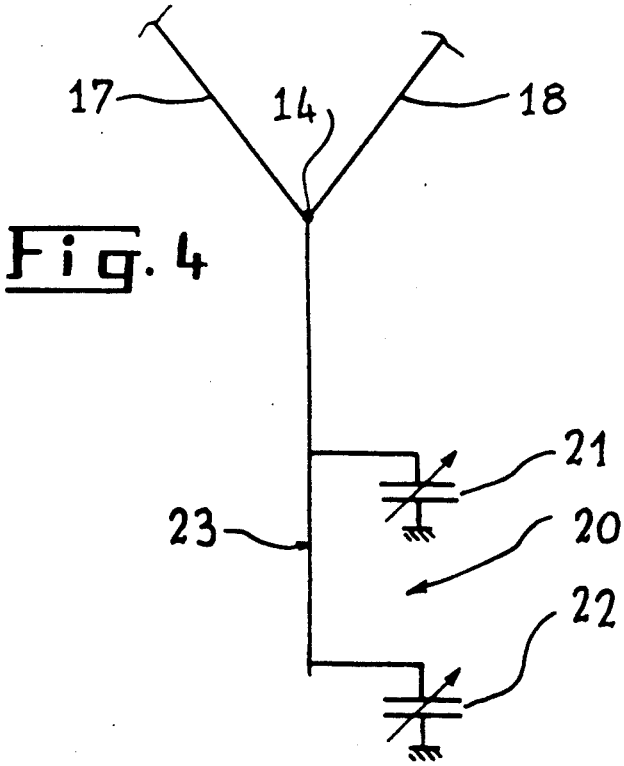
FIG. 4 shows one example of a suitable complex impedance.

FIG. 4 shows a practical embodiment of the complex impedance 20 suitable for a GD corrector operating in the 2 GHz band. This complex impedance is constituted by a transmission line 23 and two adjustable capacitors 21 and 22 disposed at the ends thereof, with the upstream capacitor 21 serving to adjust the amplitude of the delay, and with the downstream capacitor 22 serving to adjust the frequency of the delay imparted by the corrector.

The above-described GD corrector has the following advantages:

it is easy to adjust, firstly since it makes use of a single complex impedance only, and secondly because the power divider is a passive component, so it imparts very little residual GD, thereby facilitating adjusting for small delays;

its amplitude transmission curve is flat: no signals are recombined at the inlet whose phases depend on the adjustment;

it is easy to integrate since a power divider is easily constructed using microstrip technology for example, and such integration is facilitated by the small bulk of the power divider; and it is cheap since it uses only one complex impedance, and, in addition, it uses only one component constituted by a resistance.

The drawback due to the fact that a portion of the energy is reflected towards port 15 is easily overcome using present day integration techniques. Upstream from the inlet 15, it is possible to insert a small, 5 dB, attenuator preceded by a small amplifier.

Naturally, the invention is not limited to the embodiment described above, and, for example, a power divider other than a Wilkinson divider could equally well be used.

I claim:

1. A microwave frequency group delay corrector circuit comprising a complex impedance for performing group delay correction by reflection of the microwave on said complex impedance, a power divider comprising first, second and third ports, said first port normally functioning as an inlet port, said second and third ports being isolated from each other and normally functioning as outlet ports, said complex impedance being connected to said first port, said inlet microwave being applied to one said second and third ports and an outlet microwave being taken from the other of said second and third ports of the power divider, whereby the group delay corrector is easy to adjust, since it employs a single complex impedance and since the power divider is a passive component, imparts very little residual group delay, thereby facilitating adjustment for a small delay, the amplitude transmission curve of the power divider is flat, and the corrector circuit is inexpensive and easy to integrate.

2. A corrector circuit according to claim 1, wherein the power divider is a Wilkinson type divider.

3. A corrector circuit according to claim 1, wherein the complex impedance is constituted by a transmission line and two adjustable capacitors placed at respective ends of said transmission line.

* * * * *